United States Patent [19]

Marsh

[11] Patent Number: 4,631,526

[45] Date of Patent: Dec. 23, 1986

[54] THEFT PROOF ALARM BELL ASSEMBLY

[75] Inventor: John C. Marsh, East Molesey, United Kingdom

[73] Assignee: Automated Security Holdings, Ltd., United Kingdom

[21] Appl. No.: 815,175

[22] Filed: Dec. 20, 1985

Related U.S. Application Data

[63] Continuation of Ser. No. 386,771, Jun. 10, 1982, abandoned.

[51] Int. Cl.[4] ..... G08B 3/00

[52] U.S. Cl. ..... 340/396; 116/162

[58] Field of Search ..... 340/396, 392, 568, 540, 340/571, 693; 116/77, 162

[56] References Cited

U.S. PATENT DOCUMENTS 853,736 12/1905 Robins ..... 340/571 X

FOREIGN PATENT DOCUMENTS 921784 3/1963 United Kingdom .

1558707 1/1980 United Kingdom .

OTHER PUBLICATIONS

*New* 1980 *Burglar-Fire Alarm Catalog,* Mountain West, PO Box 10780 Phoenix, Arizona.

*Primary Examiner*—John W. Caldwell, Sr.

*Assistant Examiner*—Tyrone Queen

*Attorney, Agent, or Firm*—Woodard, Weikart, Emhardt & Naughton

[57] ABSTRACT

An alarm bell assembly wherein the working parts are located beneath and protected by the gong, and preferably also a cover for the assembly, being secured by means comprising a detector such as a micro-switch by which alarm drive is actuable when the bell is tampered with. A rechargeable battery is connected to an external control circuit such that the battery remains fully charged and supplies the alarm drive if the control circuit connection is severed.

11 Claims, 3 Drawing Figures

THEFT PROOF ALARM BELL ASSEMBLY

This application is a continuation, of application Ser. No. 386,771, filed June 10, 1982, now abandoned.

The present invention relates to alarm bell assemblies and particularly to a tamper-proof intruder alarm mounted in use on buildings, usually on an outside wall.

Conventional alarms have a steel cover, the thickness of which must be at least 18 gauge or a polycarbonate cover the thickness of which must be at least 3 mm., in order to comply with British Standards. Underneath the cover there is a base plate, also of 18 gauge steel or 3 mm. polycarbonate on which are mounted a gong, bell operating parts including an armature and armature drive means, and a power source, usually including batteries and wires to a central alarm control circuit.

Enterprising prospective burglars and intruders can easily disable such alarms for example by cutting through the cover and removing the batteries or cutting the wires to the control circuit or both. The alarm is rendered inoperative and, hence, ineffective. Such alarms are, therefore, not very satisfactory.

An alarm which obviates these disadvantages is required in order to foil attempting burglars and intruders.

According to the invention, we propose an alarm bell assembly comprising a gong and bell operating parts in which the operating are located beneath and protected by the gong, wherein the gong is secured by means comprising a detector by which the bell is actuable when the assembly is tampered with.

In a preferred embodiment, the alarm includes a plastics external cover, a steel base and a frame on the base, the cover being secured to the frame by a screw and the gong being secured to the frame by a second screw, the cover screw located coaxially within the gong screw. The detector is comprised of a micro-switch, located within an aperture defined by a raised portion of the frame and is operable on any of the following: removal of the cover screw or the gong screw or the alarm assembly, or movement thereof.

The power source comprises a standby rechargable battery, a relay and battery charging circuit on a printed circuit board to an external central alarm control circuit such that the battery is kept fully charged and supplies the alarm drive means if the control circuit connections are severed.

Thus, the alarm bell assembly cannot be tampered with without the micro-switch being triggered and the alarm sounding so disturbing anyone meddling with the assembly.

Furthermore, a plastics cover may be used because the gong affords the bell operating means mechanical protection and this reduces the manufacturing cost of the alarm bell assembly and also results in an attractive, weather-proof assembly.

A preferred embodiment of the present invention will now be described by way of example and with reference to the accompanying drawings, in which.

Figure 2:
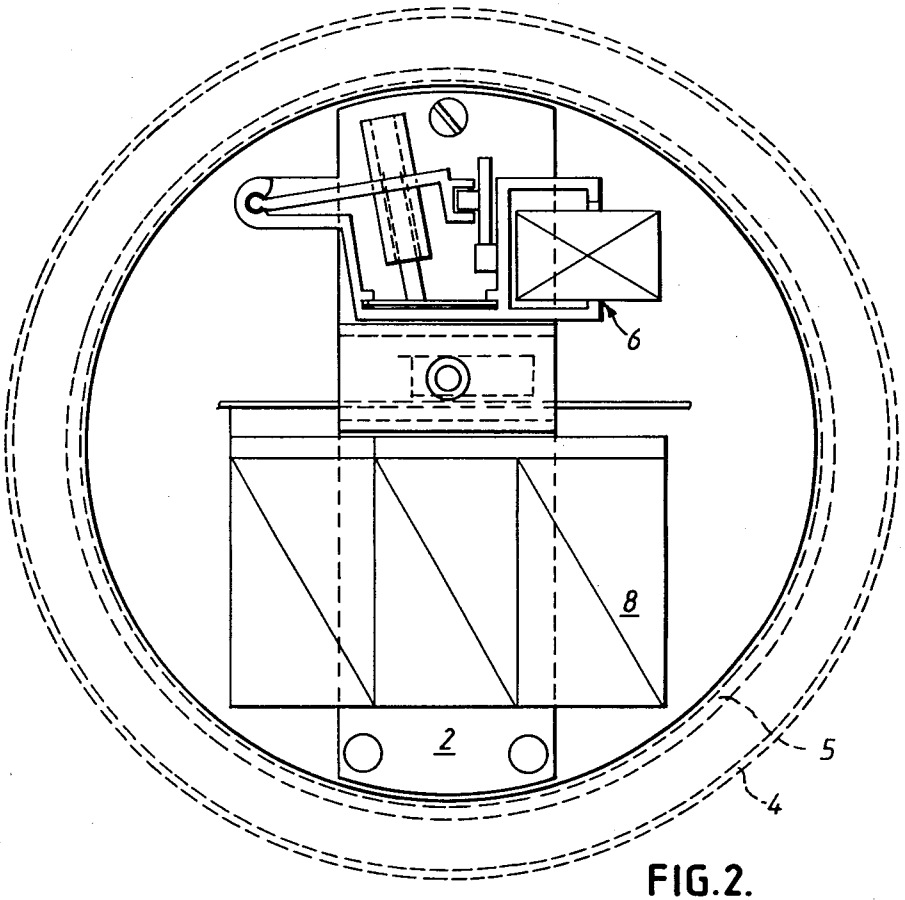
FIG. 2 is a front elevation of the alarm bell assembly, with the cover and gong removed.
Figure 1:
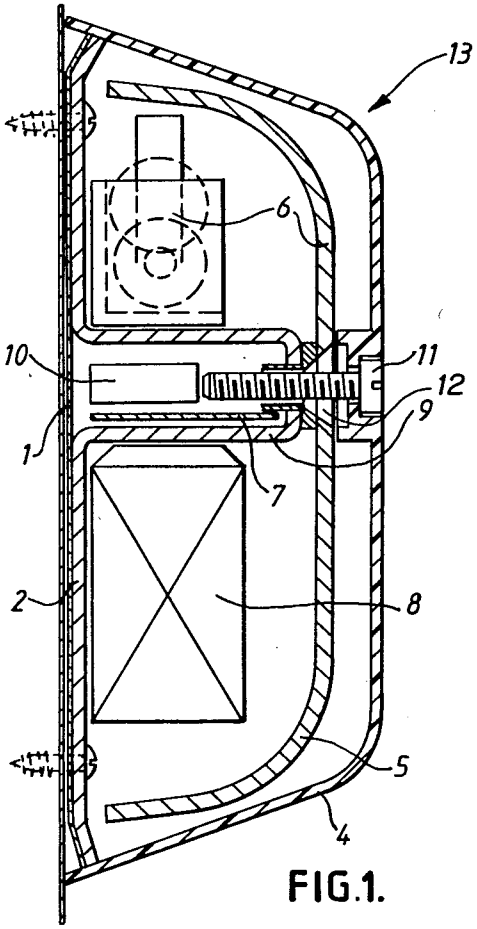
FIG. 1 is a cross-section taken from one side through the centre of an alarm bell assembly, including a gong and a cover.

An alarm bell assembly 13 for use as an intruder alarm has a steel base plate 1 and frame 2 mounted on the base plate, both of which may be fixed to a building by means of screws 3. The assembly has a plastics, outer cover 4, shown in FIG. 1, which completely extends over the top and the sides of a gong 5.

The gong 5 entirely surrounds the bell operating means seated on the base frame 2, which comprises an armature and armature drive mechanism 6 including an electric motor, a printed circuit board 7 and a rechargable battery 8.

A central raised portion 9 of the base frame defines an aperture which houses a micro-switch 10. This micro-switch serves to detect tampering and may be triggered when a first screw 11, securing the outer cover 4 to the base is turned or when a second screw 12 is turned or when the cover or gong are attempted to be removed; the second screw secures the gong to the base and the first screw is located coaxially within and is received by the second screw.

Figure 3:
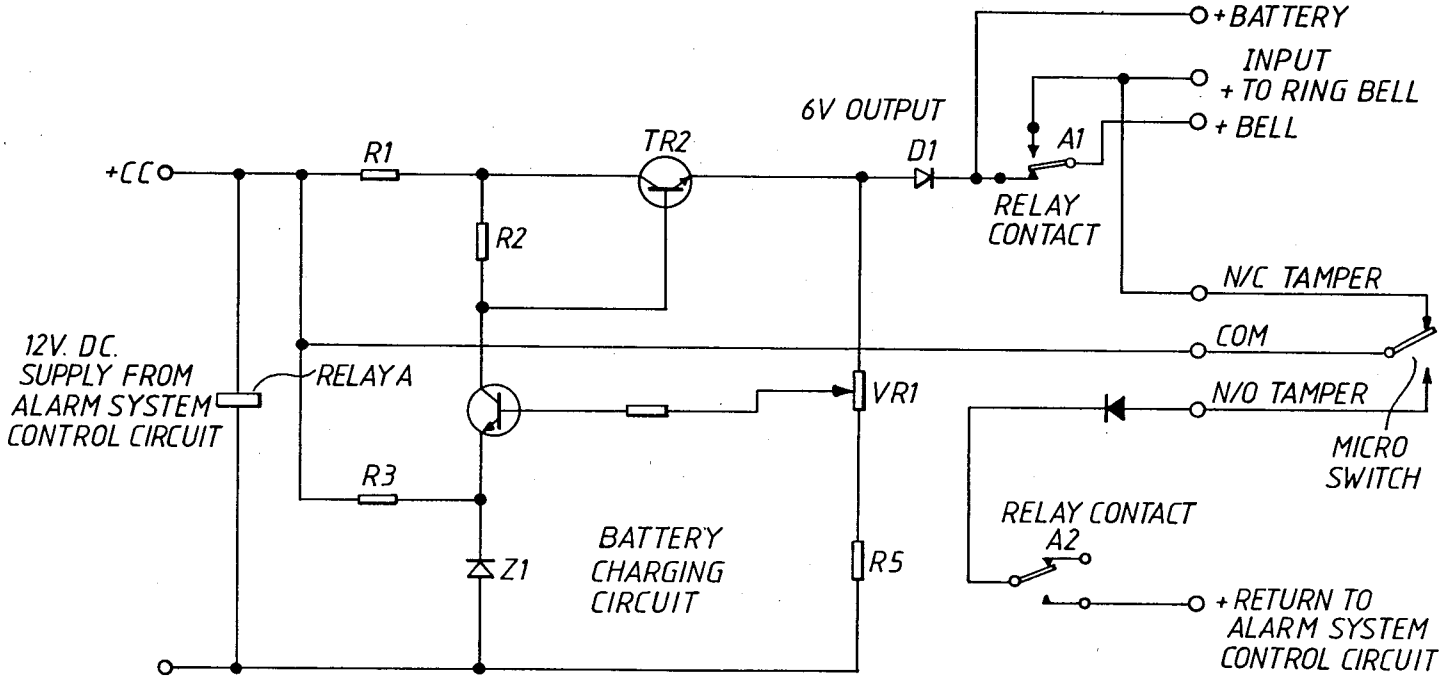
FIG. 3 is a circuit diagram showing the printed circuit board and connections therefrom to an alarm system control circuit, a battery, a bell and a micro-switch.

The printed circuit board 7, as shown in FIG. 3, includes a relay A from an external alarm system control circuit. The battery 8 is kept fully charged via the relay A.

If the micro-switch is triggered via the cover 4 or the gong 5, then return voltage is lost to the control circuit and a relay contact A2 is open; the bell is then supplied by the circuit via relay A and, simultaneously, police are alerted by the external circuit control box.

If the control circuit supply is prevented, for example by the assembly being pulled off the wall, by an intruder for example, and the wires being severed, then the battery supplies the bell.

Thus, the alarm bell is sounded if a prospective burgular or intruder attempts to dismantle the assembly as a result of the gong and the cover being secured to the assembly in such a way as to be in operable contact with the micro-switch, which is connected with the power source and bell operating means.

The assembly will, therefore, sound the alarm on being meddled with and so serve to disturb burglars and intruders and prevent the alarm being disabled.

I claim:

1. An alarm bell assembly including an alarm bell and comprising:

a supportive base;

a gong;

securing means for attaching said gong to said supportive base;

a plurality of alarm bell components concealed beneath and protected by said gong; and detector means suitably designed and cooperatively arranged with said securing means for actuating said alarm bell in response to attempts to tamper with said gong by removal of said securing means.

2. The alarm bell assembly of claim 1 which further includes a cover member and wherein said detector means includes fastener means cooperatively arranged therewith, said cover member being secured to said supportive base by said fastener means, said fastener means being cooperatively arranged such that movement of said fastener means relative to said supportive base triggers said alarm bell.

3. The alarm bell assembly of claim 2 wherein said securing means is hollow and internally threaded, and said fastener means is threadedly received by the hollow interior of said securing means.

4. The alarm bell assembly of claim 3 wherein said supportive base includes a frame having a central boss.

5. The alarm bell assembly of claim 4 wherein said detector means includes a micro-switch.

6. The alarm bell assembly of claim 5 wherein the bell operating parts include an alarm drive means and a rechargeable battery, said alarm drives means and said rechargeable battery are designed and arranged for connection to an external control circuit such that the battery is kept fully charged and supplies the alarm drive means if the control circuit connection is severed.

7. The alarm bell assembly of claim 1 which further includes a cover member and wherein said detector means includes first fastener means, said cover being secured to said supportive base by said first fastener means such that removal movement of said first fastener means triggers said detector means.

8. The alarm bell assembly of claim 7 wherein said securing means includes second fastener means, said gong being secured to said supportive base by said second fastener means, said first fastener means being coaxially disposed within said second fastener means.

9. The alarm bell assembly of claim 1 wherein said supportive base includes a frame having a central boss.

10. The alarm bell assembly of claim 1 wherein said detector means includes a micro-switch.

11. The alarm bell assembly of claim 1 wherein said alarm bell components include an alarm drive means and a rechargeable battery, said alarm drive means and rechargeable battery are designed and arranged for connection to an external control circuit such that the battery is kept fully charged and supplies the alarm drive means if the control circuit connection is severed.

* * * * *